United States Patent [19]

Swanson

[11] 4,000,903

[45] Jan. 4, 1977

[54] GOLF GLOVE

[76] Inventor: Arthur P. Swanson, 1454 Estate Lane, Glenview, Ill. 60025

[22] Filed: Oct. 21, 1975

[21] Appl. No.: 624,379

[52] U.S. Cl. ..... 273/166; 2/161 A

[51] Int. Cl.[2] ..... A63B 71/14

[58] Field of Search ..... 273/54 B, 81 R, 81 B, 273/81.4, 166; 2/159, 161 R, 161 A

[56] References Cited

UNITED STATES PATENTS

| | | | |
|---|---|---|---|
| 2,258,999 | 10/1941 | Nunn | 273/166 X |
| 2,270,882 | 1/1942 | Link | 273/166 X |
| 2,293,347 | 8/1942 | Lindfelt | 2/161 A X |
| 2,302,875 | 11/1942 | Lykins | 273/166 X |
| 2,437,404 | 3/1948 | Robinson | 273/81.4 |
| 2,456,678 | 12/1948 | Cole | 2/161 A X |
| 2,751,598 | 6/1956 | Romeo | 2/161 A X |
| 2,769,179 | 11/1956 | Love | 2/161 A |
| 3,496,573 | 2/1970 | Kuchar et al. | 273/166 X |
| 3,532,344 | 10/1970 | Masstab | 273/81.4 X |
| 3,706,453 | 12/1972 | Rosasco | 273/81.4 |

*Primary Examiner*—Richard J. Apley

*Attorney, Agent, or Firm*—Hill, Gross, Simpson, Van Santen, Steadman, Chiara & Simpson

[57] ABSTRACT

A golf glove construction has a raised ridge or bead extending across the palm portion to abut the grip portion of a golf club shaft and guide the upper hand of a golfer automatically into a proper golf grip position. When the golf club head is soled on the ground and the grip portion of the club shaft rests in the palm of a golfer wearing the glove and is abutted against the ridge or bead, the shaft will lie diagonally across the roots of the fingers, from the middle knuckle of the forefinger to a point just below the base of the little finger thereby insuring a proper grip on the club when the fingers are wrapped around the grip portion. The ridge or bead extends across the palm of the glove and may be formed by tucking a portion of the glove material around a cord which may be in the form of a bristle carrying wire providing longitudinal stiffness or the cord or wire insert may be sandwiched between the palm material of the glove and an overlying strip stitched or cemented to the palm material.

9 Claims, 7 Drawing Figures

GOLF GLOVE

FIELD OF THE INVENTION

This invention relates to the glove construction art and more particularly to a golf glove having a guide ridge to insure proper gripping of a golf club.

According to this invention, a conventional golf glove is provided with a guide ridge across the palm thereof which is effective to abut the grip portion of a golf club shaft to automatically aline the shaft for proper gripping. The guide ridge is so positioned across the palm portion of the glove that when the golf club head is soled on the ground and the upper gripping hand of a golfer wearing the glove receives the grip portion of the club shaft across the palm of the glove and against the ridge, the shaft will lie diagonally across the roots of the fingers from the middle knuckle of the forefinger to a point just below the base of the little finger. Then, when the hand is closed around the shaft with the thumb overlying the shaft about one-third of the way around the shaft and the top three fingers close together around the shaft, an automatic proper gripping of the golf club will be insured. The guide ridge is substantially parallel to a line lying diagonally across the roots of the finger from the middle knuckle of the forefinger to a point just below the base of the little finger and spaced from this line a distance substantially equivalent to the diameter of the grip portion of the shaft. Since the grip portion of the shaft is tapered the guide ridge will be canted from a line parallelling the proper finger gripping line by an amount equivalent to the taper of the shaft.

The guide ridge is narrow, does not underlie the shaft, and will not form a pocket for the shaft so that the golfer will retain the same comfortable grip and "feel" of the club shaft that is available with a conventional golf glove.

A feature of the invention includes the formation of the ridge around an insert having longitudinal stiffness with some resiliency such as a pipe cleaner type of cording where twisted wires carry radiating cotton or nylon bristles. The wire core of such cording material prevents folding of the ridge and maintains the guideline.

It is then an object of this invention to provide a golf club with a guide ridge that will insure proper gripping of the golf club shaft.

Another object of the invention is to provide a conventional golf glove with a raised guide ridge extending across the palm portion of the glove and positioned to abut the grip portion of a golf club shaft to automatically place the upper gripping hand of a golfer into proper grip position.

A further object of the invention is to provide a raised rib across the palm of a golf glove which is substantially parallel to a line extending across the roots of the fingers from the middle knuckle of the forefinger to a point just below the base of the little finger and spaced from this line a distance substantially equivalent to the diameter of the grip portion of a golf club.

Another object of the invention is to provide a golf glove for the upper gripping hand of a golfer which when receiving there against the shaft of a golf club soled on the ground, will automatically present the hand of the golfer to the shaft in a proper gripping position.

Other and further objects of this invention will be apparent to those skilled in this art from the following detailed description of the annexed sheet of drawings which show a preferred embodiment of the invention and a modification of the preferred embodiment.

ON THE DRAWINGS

AS SHOWN ON THE DRAWINGS

Figure 5:
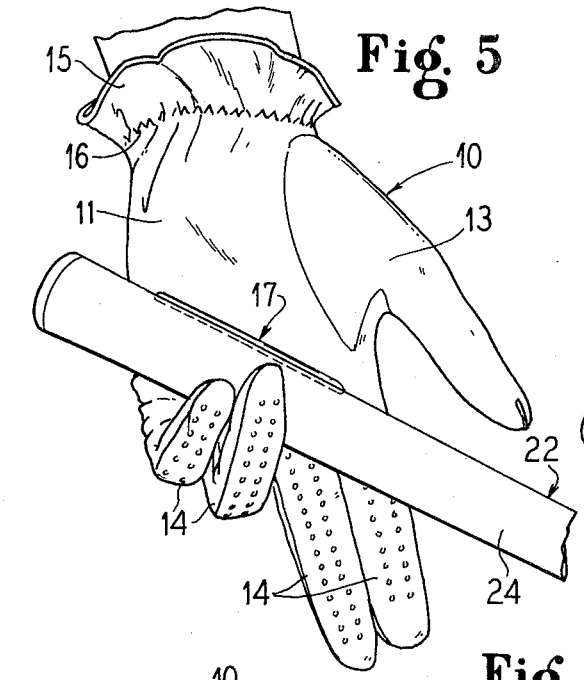
FIG. 5 is a perspective view of a golfer's left-hand wearing the glove of this invention and grasping the grip portion of a golf club shaft before closing the grip.

The drawings are directed to a left-hand glove for a right-handed golfer, but it should be understood that the invention also covers right-hand gloves for left-handed golfers since the guide ridge feature of the invention applies to the upper gripping hand of a golfer regardless of whether or not he is right- or left-handed.

It will of course be appreciated that the guide ridge on a right-hand glove will slope in the opposite direction to the guide ridge of a left-hand glove.

The glove 10 shown on the drawing is a full-fingered kid leather golfer's glove with a palm portion 11, a back portion 12, a thumb portion 13, finger portions 14, a wrist portion 15, and an elastic wrist band 16. It will be understood that this glove construction is conventional and only illustrative of a golfer's glove that can be modified to include the guide ridge of this invention. The glove 10 may be replaced with other golfer's glove designs including those with partial thumb and finger portions, "Velcro" fastener tabs and the like since the guide ridge of this invention is adaptable to all such types of golfers' gloves.

Figure 3:
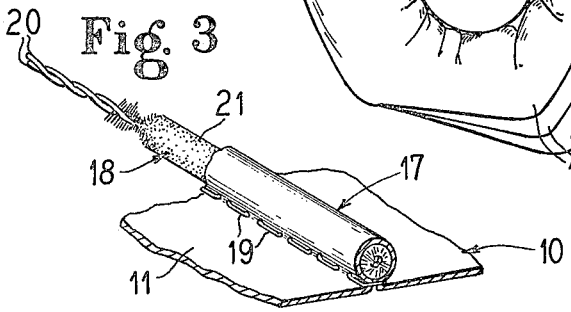
FIG. 3 is a cross-sectional, perspective view along the line III—III of FIG. 1 with portions broken away to show underlying portions.

According to this invention, as shown in FIGS. 1, 3 and 5 to 7, a guide ridge 17 is formed diagonally across the palm portion 11 of the glove between the roots of the thumb portion 13 and the finger portions 14. This ridge 17, as shown in FIG. 3, is formed by a tuck in the palm 11 of the glove material wrapped around a pipe cleaner 18 and closed by stitching 19. The pipe cleaner 18 is formed from wires 20 twisted around fibres 21 which radiate like bristles from the wires to provide a cylindrical core for the ridge 17. The ridge 17 is preferably about one-quarter of an inch in diameter and the pipe cleaner core provides longitudinal stiffness and radial resilience to the ridge thereby preventing it from creasing, folding over, or collapsing. At the same time, however, the ridge 17 is sufficiently deformable so as to follow the contour of the golfer's hand.

Figure 1:
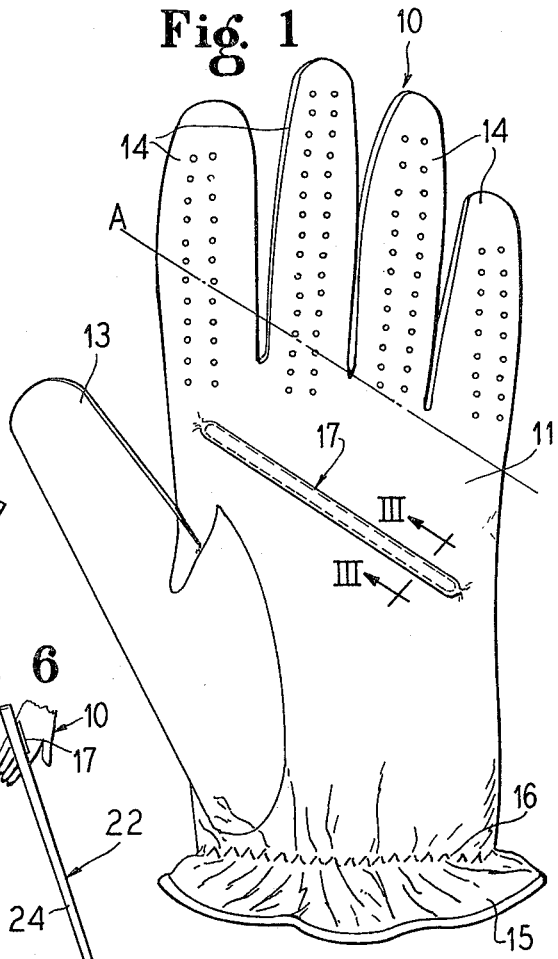
FIG. 1 is a plan view of the palm portion of a golf glove according to this invention.

As shown in FIG. 1, the line A across the glove 10 extends diagonally across the roots of the fingers from the middle knuckle of the forefinger to a point just below the base of the little finger. This line indicates the correct position for the grip portion of a golf club shaft when the club is soled on the ground and the grip portion is cradled in the open palm of the left-hand. The ridge 17 is positioned substantially parallel to this line A but spaced therefrom a distance substantially equal to the diameter of the golf club shaft at the zone to be gripped by the left-hand. Since the conventional golf club shaft is tapered at the zone gripped by the left-hand, the ridge 17 will converge slightly toward the line A to accommodate the taper.

Figure 6:
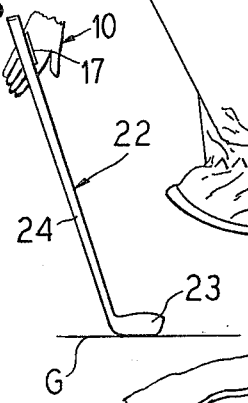
FIG. 6 is a diagrammatic view showing a golf club soled on the ground and with the grip portion of its shaft abutted by the ridge in the palm of a golf glove of this invention.
Figure 7:
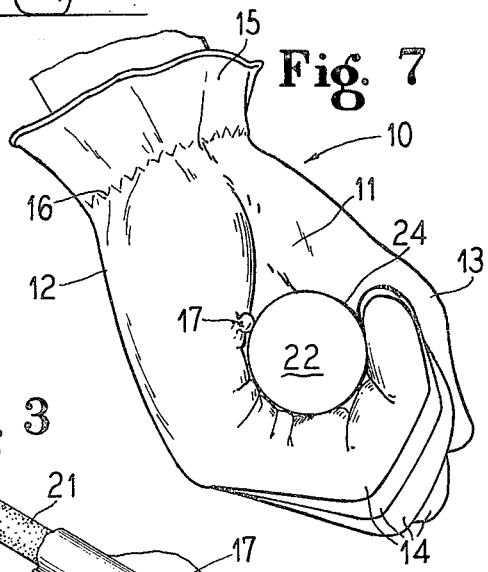
FIG. 7 is a perspective view similar to FIG. 5 but showing the closed grip position of the golfer's left-hand.

As shown in FIGS. 5 to 7, a golf club 22 having a head 23 and a tapered shaft 24 extending from the head to a gripping end has the head portion 23 soled on the ground G as shown in FIG. 6 and the gripping end of the shaft 24 grasped by a wearer of the glove 10 with the palm 11 of the glove being initially cupped around the shaft to abut the shaft along the length of the ridge 17 as shown in FIGS. 5 and 6. Then, the fingers are wrapped around the shaft 24 as shown in FIG. 7, and the ridge 17 will automatically align the shaft along the line A of FIG. 1 to insure a proper grip. As shown in FIG. 1, the ridge 17 extends substantially completely across the palm 11 of the glove construction.

A conventional golf club shaft has a gripping zone for the left-hand that tapers from a diameter of about one-inch at the heel of the hand to a diameter of about seven-eights of an inch at the thumb portion of the hand. Thus the shaft decreases about one-eighth inch in diameter along the grip portion thereof that is spanned by the left-hand of the golfer. The ridge 17 to align the golf club shaft with the line A of FIG. 1 should then converge about one-eighth of an inch toward the line A from its heel and to its thumb-end.

The ridge 17 not only automatically properly aligns the golfer's left-hand relative to the golf club shaft, but also, as shown in FIG. 7, affords an abutment to maintain this alignment after the shaft is firmly gripped by the golfer. Misalignment after initial gripping is therefore prevented.

Figure 2:
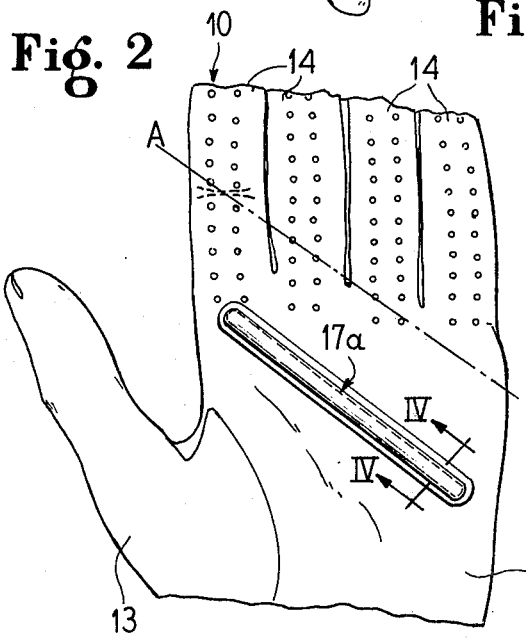
FIG. 2 is a fragmentary view similar to FIG. 1 showing a modification of the glove construction.
Figure 4:
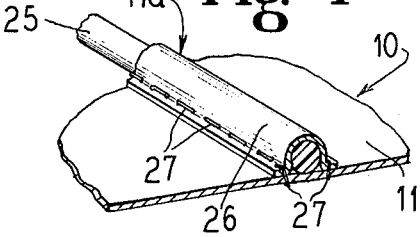
FIG. 4 is a cross-sectional, perspective view along the line IV—IV of FIG. 2.

As shown in FIGS. 2 and 4, a modified ridge **17-*a* is provided diagonally across the palm 11 of the glove 10 in the same relationship with the line A as described above in connection with the ridge 17. The modified ridge 17-*a* is formed from a cylindrical cord 25 which may be composed of tightly woven fabric twine, plastic or rubber rods or the like relatively stiff but bendable and somewhat resilient material. This cord 25 is laid on the outer surface of the palm portion 11 of the glove and a covering strip 26 of the same glove material forming the palm 11 such as kid leather, is draped over the cord 25 and stitched along the length thereof on both sides of the cord to the palm portion 11**.

The ridge **17-*a* functions in the same manner as the ridge 17**.

The stitching 19 and 27 for the ridges 17 and **17-*a* can be replaced with adhesive or other bonding material. Further, the cores 18 or 25 could be secured directly by stitching or bonding material to the palm portion of the glove without using the overlying tuck or cover 26** but such a tuck or cover is desirable to prevent bowing or humping of the ridge.

From the above description, it will therefore be understood that this invention provides a golfer's glove which will insure a correct gripping of the golf club shaft by a wearer of the glove.

I claim as my invention:

1. In a golf glove for the upper hand of a golfer, having a palm portion, a back portion, a thumb portion and finger portions, the improvement of a raised elongated narrow ridge extending diagonally across substantially the entire palm portion between the thumb and finger portions and secured to the palm portion along its entire length, a one-piece core in said ridge extending along the length of the ridge effective to hold the ridge upright and against buckling, said ridge being substantially parallel to a line extending across the palm and finger portions of the glove from the middle knuckle of the forefinger to just below the base of the little finger and spaced from said line a distance substantially equal to the diameter of the grip portion of a golf club shaft to be gripped by the upper-hand of a golfer, and said narrow ridge having a width insufficient to form an obstruction between the palm portion of the glove and the grip portion of the club shaft.

2. The golf glove of claim 1 wherein the ridge has a cross section diameter of about one-quarter of an inch and a length extending from adjacent the base of the palm portion of the glove to the thumb portion of the glove.

3. The golf glove of claim 1 wherein said ridge is composed of a tucked portion of the palm of the glove surrounding said core.

4. The golf glove of claim 1 wherein said core is a cylindrical cord of woven fabric twine.

5. The golf glove of claim 1 wherein the ridge is formed by a cover secured to the palm of the glove around the core.

6. The golf glove of claim 1 wherein said ridge is spaced from said line a distance of about one inch.

7. A golf glove comprising a palm portion, a thumb portion, finger portions, and a raised elongated narrow ridge extending diagonally across substantially the entire palm portion between the thumb and finger portions and secured along its length to said palm portion, a core rod in said ridge along the entire length thereof, said narrow ridge adapted to receive a tapered golf club shaft thereagainst without forming an obstruction between the palm portion of the glove and the club shaft, said ridge being substantially parallel to a line extending across the palm and finger portions of the glove from the middle knuckle of the forefinger to just below the base of the little finger and spaced from said line a distance substantially equal to the diameter of the grip portion of a tapered golf club shaft to be gripped by the upper-hand of a golfer wearing the glove and converging toward said line to conform with the taper of the grip portion of the tapered golf club shaft being gripped by the user of the glove.

8. The golf glove of claim 7 wherein the ridge is composed of a tucked portion of the palm of the glove around the core.

9. The golf glove of claim 7 wherein said core is a cord of woven fabric.

* * * * *